US009683795B1

(12) United States Patent
Novak et al.

(10) Patent No.: US 9,683,795 B1
(45) Date of Patent: Jun. 20, 2017

(54) CHARGING HANDLE

(71) Applicant: Sportco, Inc., Holbrook, NY (US)

(72) Inventors: Robert Arthur Novak, Holbrook, NY (US); Roy William Stedman, Austin, TX (US)

(73) Assignee: Sportco, Inc., Holbrook, NY (US)

( * ) Notice: Subject to any disclaimer, the term of this patent is extended or adjusted under 35 U.S.C. 154(b) by 0 days.

(21) Appl. No.: 15/349,030

(22) Filed: Nov. 11, 2016

Related U.S. Application Data

(60) Provisional application No. 62/279,866, filed on Jan. 18, 2016.

(51) Int. Cl.
*F41A 3/72* (2006.01)
*F41A 35/06* (2006.01)

(52) U.S. Cl.
CPC ..... *F41A 3/72* (2013.01); *F41A 35/06* (2013.01)

(58) Field of Classification Search
CPC ..... F41A 3/72; F41A 5/24; F41A 5/28; F41A 35/06
USPC ..... 89/1.4, 193, 191.01, 194
See application file for complete search history.

(56) References Cited

U.S. PATENT DOCUMENTS 3,225,653 A * 12/1965 Packard ..... F41A 3/72 42/16
7,707,921 B1 * 5/2010 Hoel ..... F41A 3/20 42/16
7,832,322 B1 * 11/2010 Hoel ..... F41A 3/20 42/16
8,863,632 B1 * 10/2014 O'Malley ..... F41A 3/72 42/16
8,899,138 B2 * 12/2014 Brown ..... F41A 3/72 89/1.4
9,389,032 B2 * 7/2016 Daley, Jr. ..... F41A 3/66
9,435,593 B2 * 9/2016 McGinty ..... F41A 35/06
2011/0174139 A1 * 7/2011 Olsen ..... F41A 35/06 89/1.4
2011/0265636 A1 * 11/2011 Overstreet ..... F41A 3/72 89/1.4
2012/0291612 A1 * 11/2012 Kincel ..... F41A 35/06 89/1.4
2013/0092014 A1 * 4/2013 Kincel ..... F41A 3/72 89/1.4
2013/0174457 A1 * 7/2013 Gangl ..... F41A 3/72 42/16
2013/0192113 A1 * 8/2013 Melville ..... F41A 7/00 89/1.4
2014/0060293 A1 * 3/2014 Gomez ..... F41A 3/72 89/1.4
2014/0318356 A1 * 10/2014 Cupps ..... F41A 3/72 89/1.4
2014/0345444 A1 * 11/2014 Hillman ..... G01N 15/06 89/1.4
2015/0192376 A1 * 7/2015 Dickinson ..... F41A 3/72 89/1.4

(Continued)

*Primary Examiner* — Michael David
(74) *Attorney, Agent, or Firm* — Abelman, Frayne & Schwab

(57) ABSTRACT

A charging handle for a firearm includes a primary handle and secondary handle in communication with a latch for engaging to or releasing from a firearm's bolt carrier, allowing for ambidextrous operation of the charging handle, allowing for operation that overcomes interference from optical sights on a firearm, and allowing for operation in various firing positions.

8 Claims, 8 Drawing Sheets

(56) References Cited

U.S. PATENT DOCUMENTS

| | | | | |
|---|---|---|---|---|
| 2015/0233657 | A1* | 8/2015 | Barker | F41A 35/06 89/1.4 |
| 2015/0308762 | A1* | 10/2015 | McGinty | F41A 3/72 89/1.4 |
| 2015/0345886 | A1* | 12/2015 | Lavalley | F41A 17/38 42/6 |
| 2016/0033219 | A1* | 2/2016 | Meier | F41A 3/66 89/191.01 |

* cited by examiner

CHARGING HANDLE

CLAIM FOR PRIORITY

This application claims priority to and incorporates by reference U.S. Provisional Patent Application No. 62/279,866, filed on 18 Jan. 2016.

FIELD OF THE INVENTION

This invention is generally directed to a charging handle for use with a firearm.

BACKGROUND OF THE INVENTION

A charging handle for a firearm enables a shooter to retract and lock a bolt carrier in a firearm receiver to chamber a first round from a new magazine while in a firing position and without significantly moving the firearm from a sighted position. In addition, a charging handle facilitates the clearing of a misfired round, jammed ammunition, and bolt malfunctions, all while the shooter remains in a shooting position. Also, if the bolt does not retract sufficiently following firing, such as when shooting low recoil ammunition, the charging handle enables the shooter to manually chamber the next round.

What is needed is a charging handle that allows for ambidextrous operation, serving right-handed and left-handed users, serving on firearms that include rear-extending optical sights, and serving to make operation easy in any firing position.

SUMMARY OF THE INVENTION

The present invention provides a substantial improvement in the design of a charging handle. It places a primary handle and secondary handle into communication with a latch for engaging to or releasing from a firearm's bolt carrier.

The charging handle configured and arranged as described will provide improved functionality, with a minimum of moving parts.

BRIEF DESCRIPTION OF THE DRAWINGS

Preferred embodiments of the invention are described herein below with reference to the drawings wherein.

DETAILED DESCRIPTION OF THE INVENTION

The present invention is directed towards a charging handle for use with the M16 family of firearms which includes the AR15, AR10, M16 and M4 rifles of all varieties and other derivatives to include those which use a gas piston or blowback operation in place of a gas tube.

Figure 1:
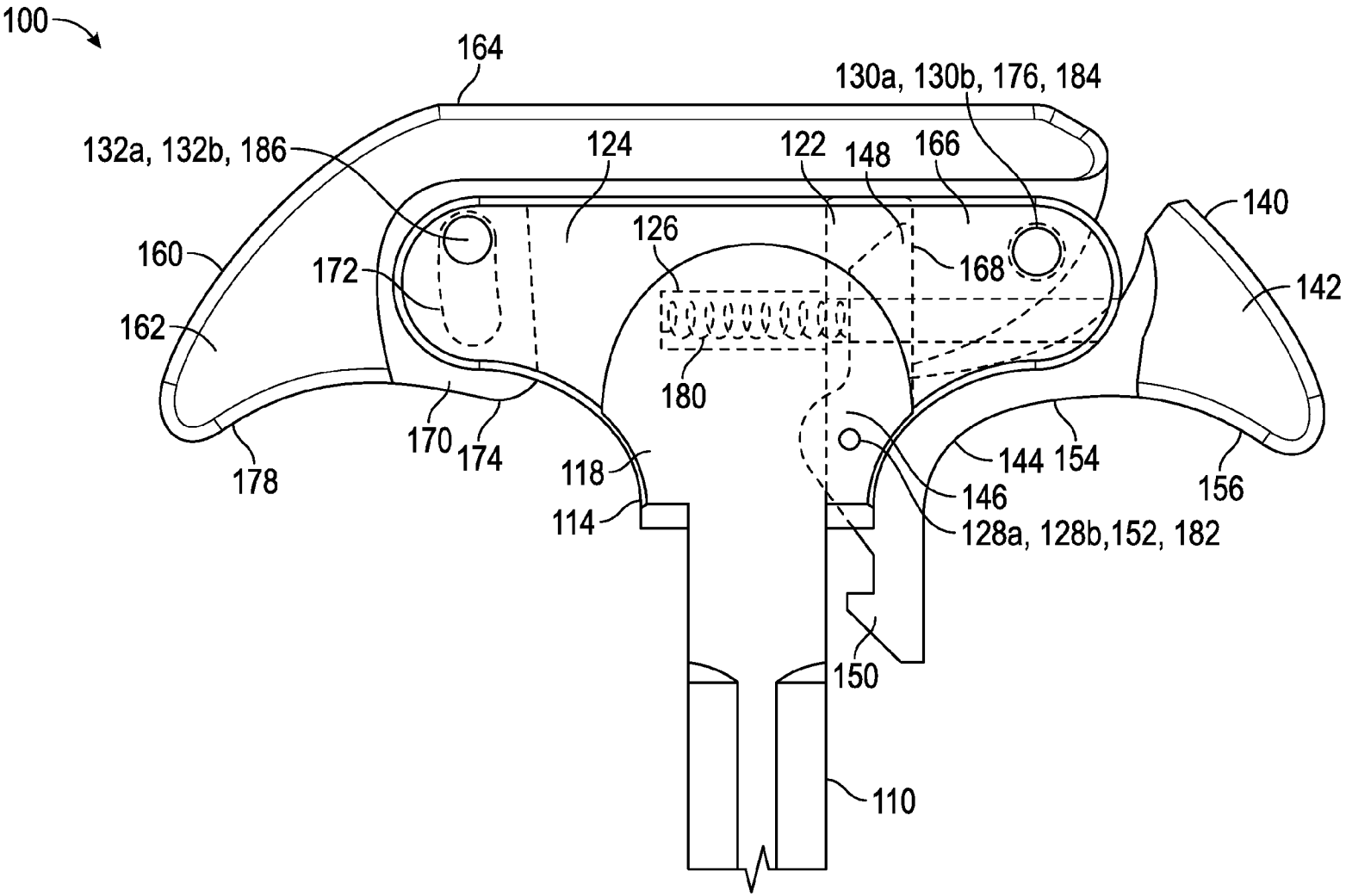
FIG. 1 illustrates a detail of a front elevation of a charging handle, showing internal structure.

As shown in FIG. 1, the present invention is directed to a charging handle 100 consisting of a shaft 110, primary handle 140, secondary handle 160, spring 180, and connectors 182 and 184.

Figure 2:
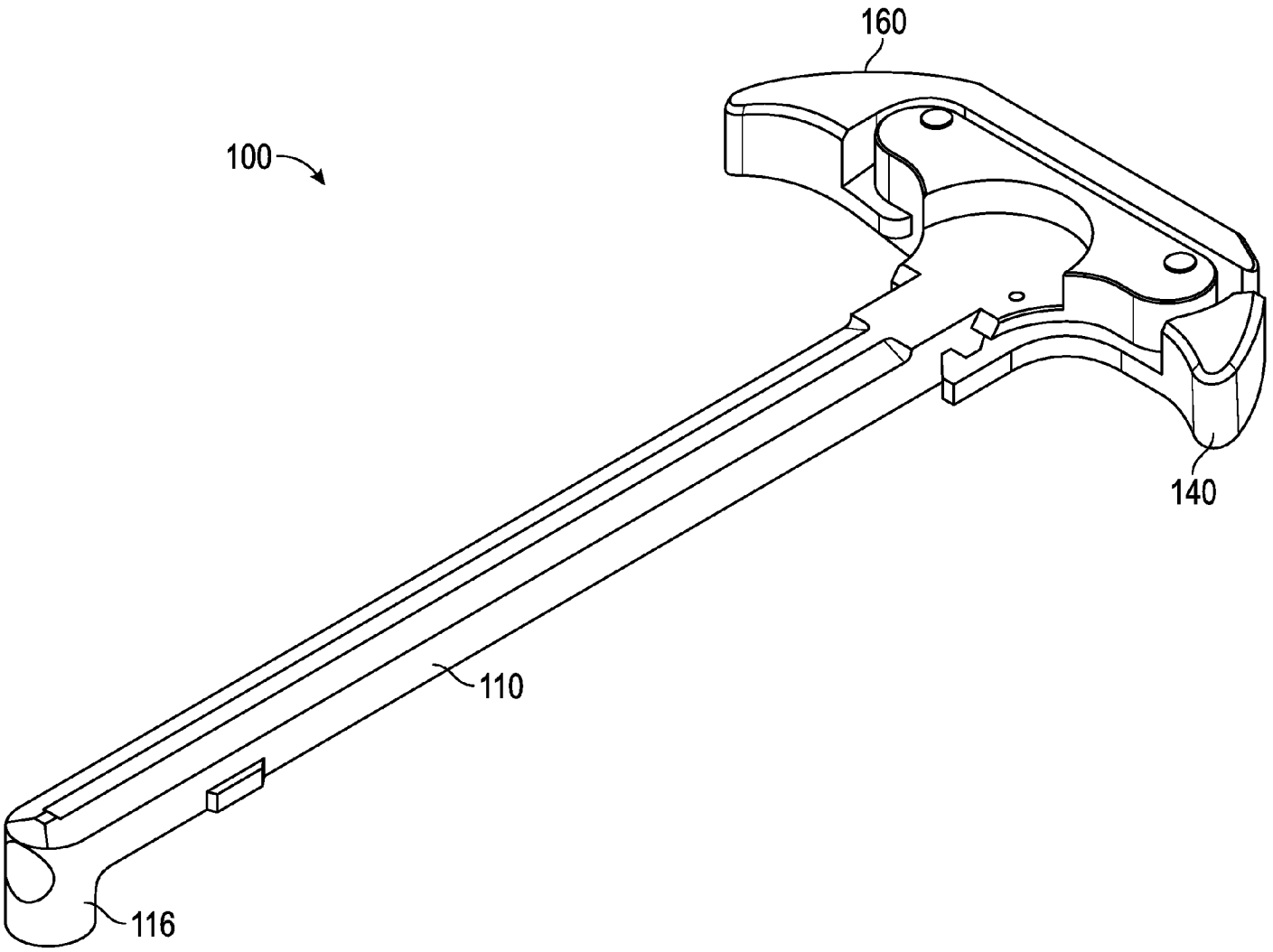
FIG. 2 illustrates a front, right, and bottom perspective view of the complete charging handle.
Figure 3:
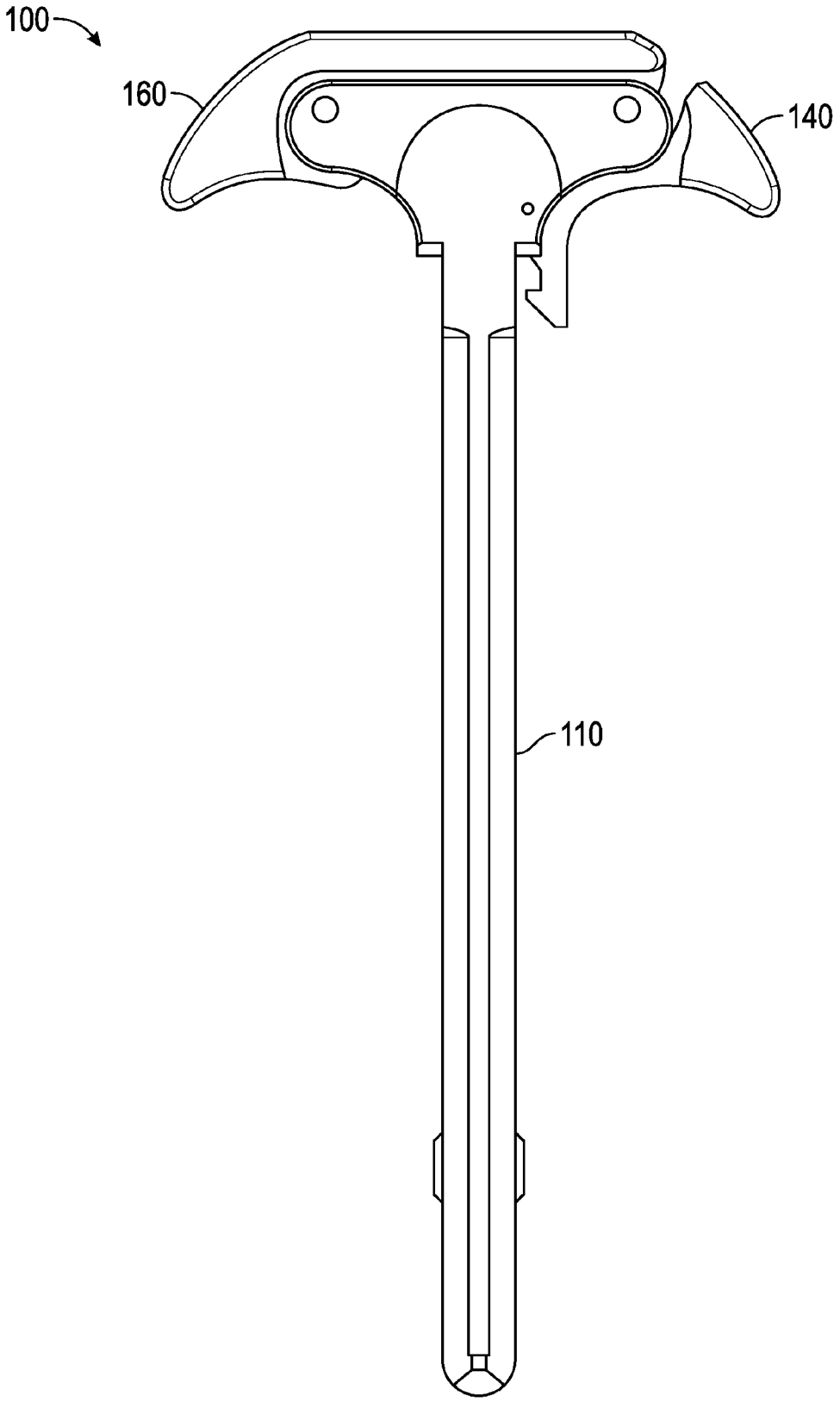
FIG. 3 illustrates a front elevation of the charging handle.
Figure 4:
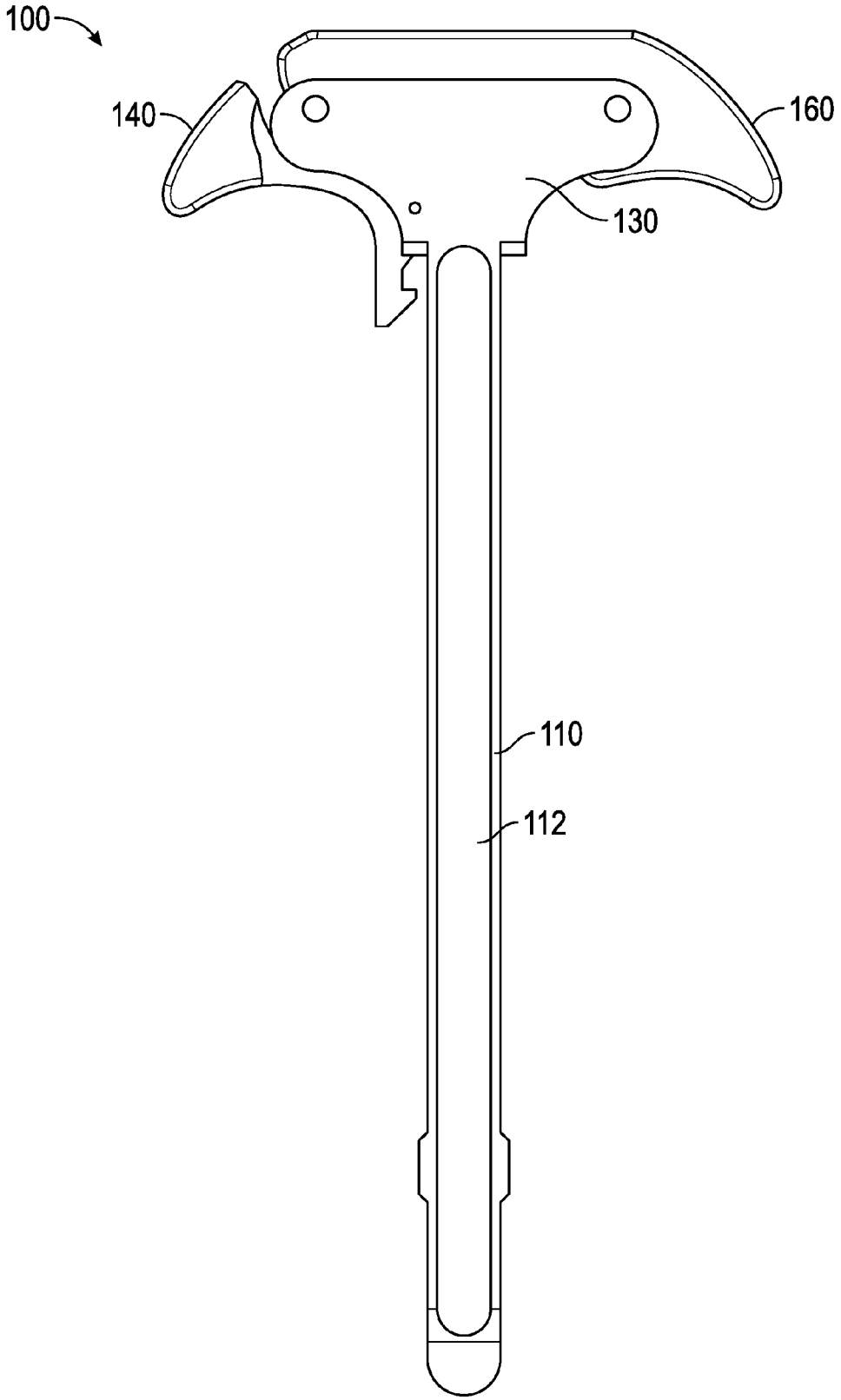
FIG. 4 illustrates a rear elevation of the charging handle.
Figure 5:
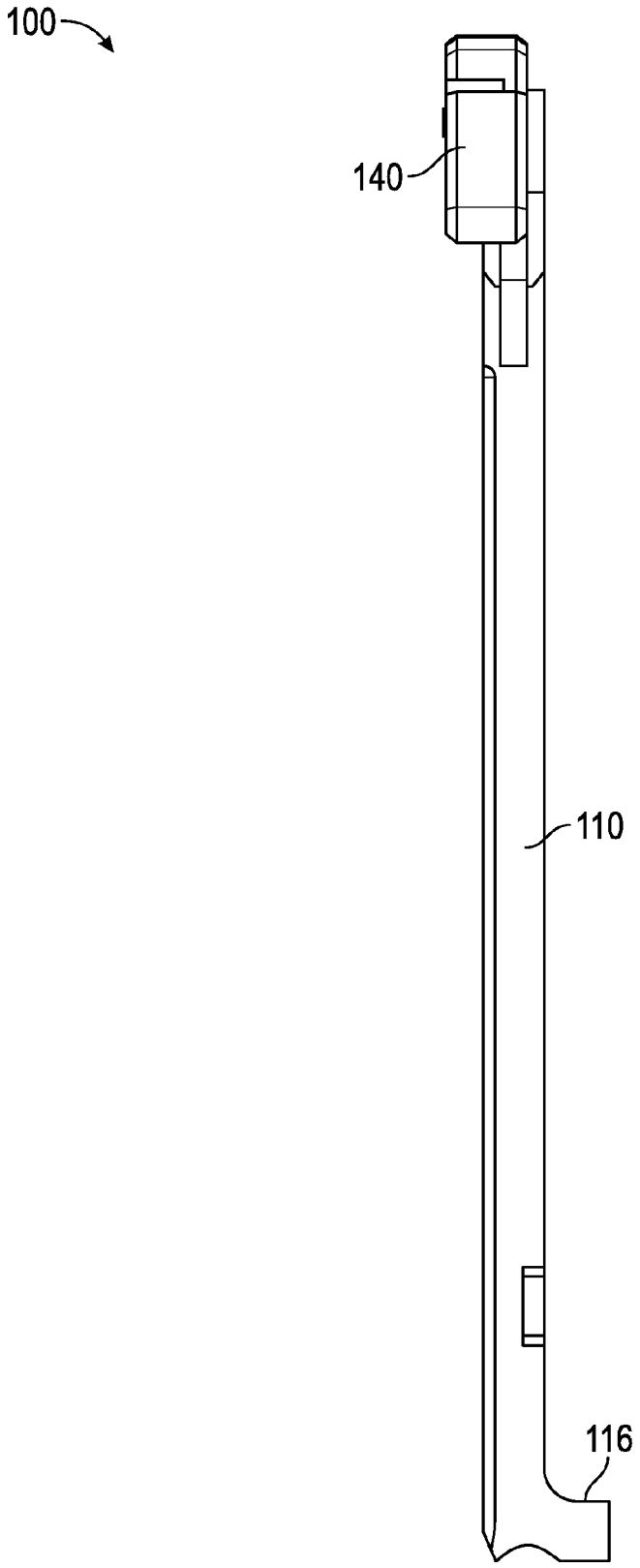
FIG. 5 illustrates a right side elevation of the charging handle.
Figure 6:
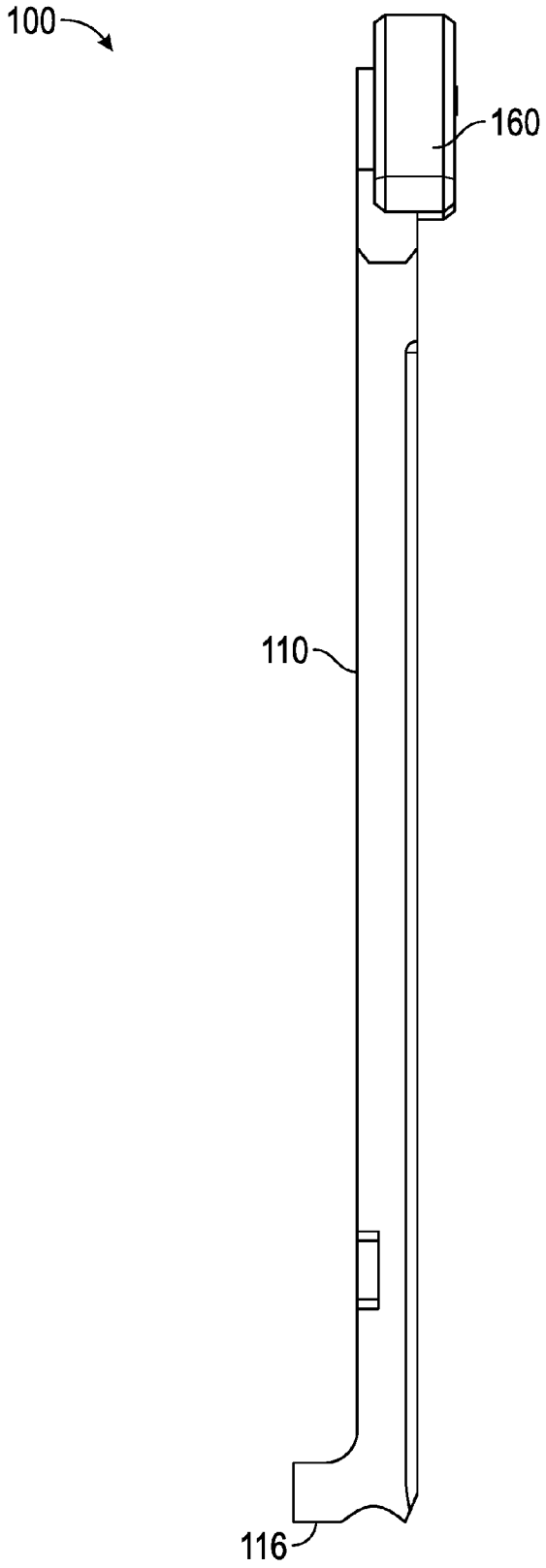
FIG. 6 illustrates a left side elevation of the charging handle.
Figure 7:
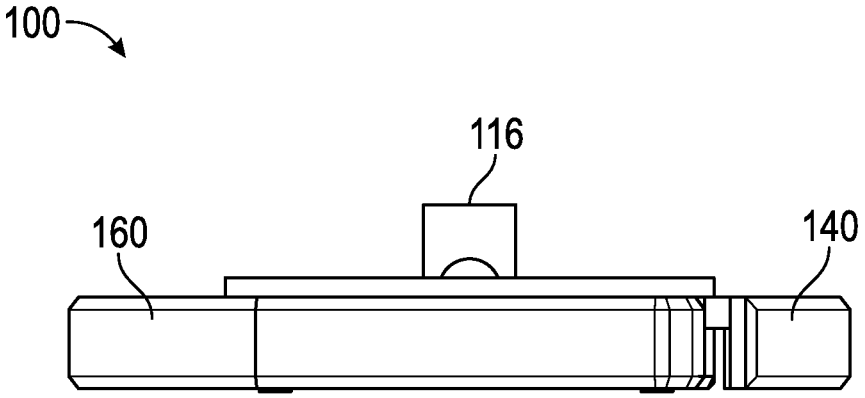
FIG. 7 illustrates a top plan of the charging handle.
Figure 8:
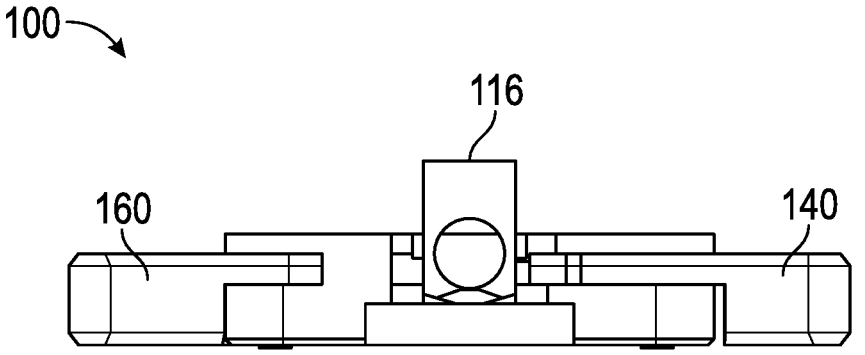
FIG. 8 illustrates a bottom plan of the charging handle.
Figure 9:
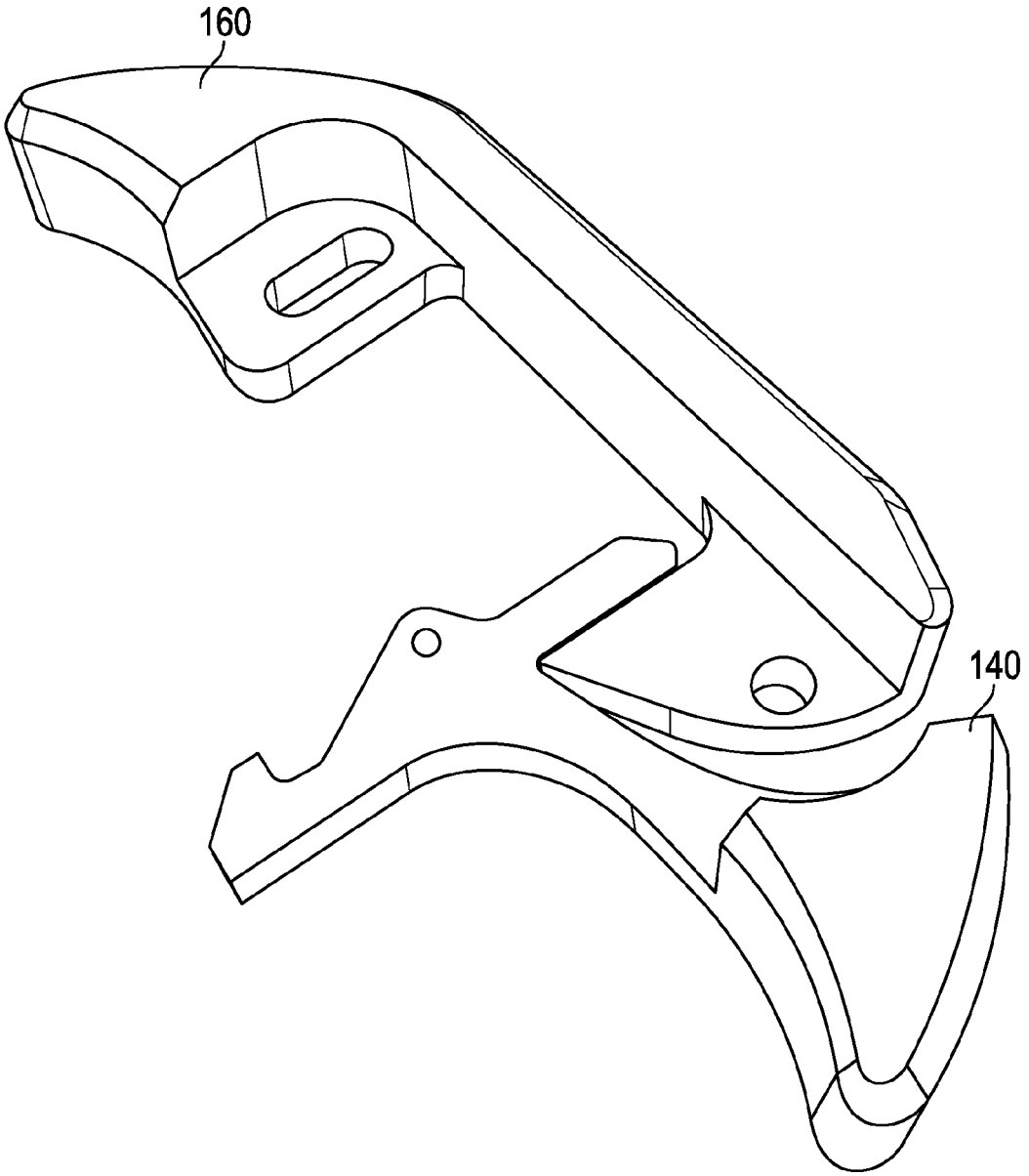
FIG. 9 illustrates a front, right, and bottom perspective view of the primary and secondary handles of the charging handle.

Shaft 110 is connected to a transverse head 114, and in a preferred embodiment shaft 110 and head 114 are integrally connected. The lower portion of charging handle 100 has a bolt carrier engagement portion 116 (shown in FIG. 2) which is configured to engage on a portion of a bolt carrier, well known in the prior art as it relates to the M16 family of firearms. Shaft 110 includes a groove 112 (shown in FIG. 4). It will be understood that charging handle 100 is intended to be employed with any M16 type firearm; however with minor modifications, some of its features could be more widely used for other firearms as well. It will also be understood that the charging handle is housed within an upper receiver of an M16 type rifle.

The head 114 has a front surface 118 and a rear surface 130 (shown in FIG. 4), with a first recess 122 between the front surface 118 and the rear surface 130 to the right of a centerline of shaft 110 and a second recess 124 between the front surface 118 and the rear surface 130 to the left of the centerline of shaft 110. First recess 122 includes opening 126 for spring 180. Head 114 includes holes 128*a*, 128*b*, 130*a*, and 130*b*, and in a preferred embodiment also includes holes 132*a*, and 132*b*.

Primary handle 140 is integrally formed with a first body portion 142, arm 144, first pivot portion 146, first protrusion 148, and latch 150. Arm 144 includes a first charging surface 154 facing the bottom of charging handle 100, and first body portion 142 includes a first release surface 156 facing the bottom of charging handle 100. Arm 144 has two ends, connecting at its first end to first body portion 142, and connecting at its second end to first pivot portion 146. Branching from the first pivot portion 146, approximately transversely from arm 144, are latch 150 and first protrusion 148. Hole 152 is provided within first pivot portion 146.

Primary handle 140 is pivotally mounted to head 114, with first protrusion 148, first pivot portion 146, and part of arm 144 fitting within first recess 122. Hole 152 lines up between holes 128*a* and 128*b*, with first connector 182 passing through the holes and connecting primary handle 140 to head 114, so that primary handle 140 pivots about first connector 182.

Secondary handle 160 is integrally formed with a second body portion 162, top surface 164, second pivot portion 166, and flange 170. Second body portion 162 includes a second charging surface 174 and a second release surface 178 which faces the bottom of charging handle 100. Hole 176 is provided within second pivot portion 166.

In a preferred embodiment, slot 172 is provided within flange 170. Slot 172 lines up between holes 132*a* and 132*b*, with third connector 186 passing through slot 172 and the holes. The diameter of slot 172 is large enough that third connector 186 will not touch the sides of slot 172 as secondary handle 160 pivots. Rather, third connector 186 will act to stop the rotation of secondary handle 160 when it contacts the top and bottom of slot 172.

Secondary handle 160 is pivotally mounted to head 114, with top surface 164 covering the top of head 114. Part of flange 170 and second pivot portion 166 fit within second recess 124. Hole 176 lines up between holes 130*a* and 130*b*, with second connector 184 passing through the holes and connecting secondary handle 160 to head 114, so that secondary handle 160 pivots about second connector 184.

Spring 180, which is installed within opening 126, biases first protrusion 148. When spring 180 is uncompressed to the greatest extent possible while charging handle 100 is assembled, first protrusion 148 rests against an edge 168 of second pivot portion 166. This edge 168 blocks first protrusion 148 from moving further, and traps spring 180 within opening 126. In this position, when charging handle 100 is placed within a firearm for which it is designed, latch 150 engages with the upper receiver of the firearm. While thus engaged, a user can pull charging handle 100, by pulling on head 114, first charging surface 154, and second charging surface 174, or a combination thereof. This action causes the bolt carrier engagement portion 116 to engage and operate the bolt carrier of the firearm.

To release the charging handle 100 when installed on a firearm, the user can retract the primary handle 140 or the secondary handle 160 individually or simultaneously to disengage the latch 150 from the upper receiver of the firearm. The user may prefer one handle over the other based on factors such as whether the user is right-handed or left-handed, the current firing position of the user, and whether the firearm has an optical gun sight or other obstruction that reduces access to one handle.

To retract the primary handle 140, the user pulls first release surface 156 upwards, toward the top of charging handle 100. This causes primary handle 140 to rotate about first connector 182 to the extent allowed by first recess 122. This rotation compresses spring 180, causing latch 150 to move away from shaft 110. This action causes latch 150 to disengage from the upper receiver of the firearm, allowing the user to remove charging handle 100 from the firearm. If a user releases the first release surface 156, spring 180 decompresses, pushing first protrusion 148 until it is blocked from moving further by edge 168 of second pivot portion 166.

To retract secondary handle 160, the user pulls second release surface 178 upwards, toward the top of charging handle 100. This causes secondary handle 160 to pivot about second connector 184. Edge 168 rotates clockwise, putting pressure on first protrusion 148 of the primary handle 160. This compresses spring 180, allowing the actions described above. A user can pivot secondary handle 160 to the extent allowed by edge 168 pushing against first protrusion 148, which in turn is limited by the dimensions of first recess 122. In the preferred embodiment where slot 172 is present, the interaction of third connector 186 reaching the bottom portion of slot 172 will also block further movement of secondary handle 160. If a user releases second release surface 178, spring 180 decompresses, pushing away first protrusion 148. First protrusion 148 places pressure on edge 168, causing second pivot portion 166 to rotate away. First protrusion 148 continues to move until its progress is blocked by the edge 168 of second pivot portion 166.

The lengths of primary handle 140 and secondary handle 160 each extend laterally past the ends of head 114. In various embodiments the lengths, widths, and shapes of primary handle 140 and secondary handle 160 vary. In a preferred embodiment, the lengths of primary handle 140 and secondary handle 160 are such that they extend laterally beyond head 114 an equal distance as measured from a center line of the head 114. In a preferred embodiment, the tops of primary handle 140 and secondary handle 160 have a convex shape, while the undersides have a convex shape.

In a preferred embodiment, a texture is applied to first release surface 156 and second release surface 178 to aid the user in acquiring and maintaining a grip on either or both of primary handle 140 and secondary handle 160, respectively, in order to retract the handle(s) and release charging handle 100 from a firearm. In one embodiment, the texture applied comprises a series of latitudinal furrows which form a series of peaks and valleys along the surfaces of first release surface 156 and second release surface 178.

In another preferred embodiment, a texture is applied to first charging surface 154 and second charging surface 174 to aid the user in acquiring and maintaining a grip on the charging handle 100 in order to operate the bolt and carrier of the firearm.

Shaft 110, primary handle 140, and secondary handle 160 can be constructed out of metal including aluminum, steel, and stainless steel, as well as other materials including thermoplastic, carbon fiber, fiberglass resin laminates such as G10.

Each connector 182, 184, 186 is constructed from a solid piece of metal, preferably steel, that is resistant to shearing that may occur when a force is applied to first release surface 156 and/or second release surface 178. Connectors 182, 184, 186 can be roll pins, screws, bolts, or other known attachment means. The preferred embodiment where slot 172 is provided is especially desirable in limiting a danger of shearing, as the long pivot arm of secondary handle 160 could allow for significant force to be generated at second pivot portion 166. Third connector 186 acts to stop the movement of secondary handle 160 when it reaches the bottom of slot 172.

While preferred embodiments of the present invention have been illustrated and described herein, it will be apparent that such embodiments are provided by way of example only. Numerous variations, changes and substitutions will be apparent to those skilled in the art without departing from the invention, the scope of which is to be determined by the following claims.

We claim:

1. A charging handle for a firearm comprising:

a shaft for interfacing with a bolt carrier in the firearm, the shaft mounted to a transverse head with a front surface and a rear surface, wherein a first recess is set between the front surface and the rear surface of the head to the right of a centerline of the shaft, within which first recess is an opening into which is placed a spring, and wherein a second recess is set between the front surface and the rear surface of the head to the left of the centerline of the shaft;

a primary handle with a first body, a first pivot portion, an arm with one end mounted to the first body and a second end mounted to the first pivot portion, and branching from the first pivot portion are a first protrusion and a latch, wherein the primary handle is pivotally mounted to the head via the first pivot portion such that the first protrusion, first pivot portion, and part of the arm are positioned within the first recess, and such that the first protrusion is biased by the spring;

and a secondary handle with a second body, a top surface with one end integrally connected to the second body and a second end integrally connected to the second pivot portion, the secondary handle being pivotally mounted to the head via the second pivot portion such that the second pivot portion is positioned within the second recess, and such that the second protrusion rests against the first protrusion, through which the second protrusion is also biased by the spring;

wherein when the charging handle is installed in the firearm and the primary and secondary handles are allowed to move freely, the latch engages with an upper receiver of the firearm, and wherein when a user pulls on a first release surface of the first body of the primary handle, the primary handle pivots about the pivotal mounting of its first pivot portion, with the first protrusion compressing the spring, or wherein when the user pulls on a second release surface of the second body of the secondary handle, the secondary handle pivots about the pivotal mounting of its second pivot portion, with the second protrusion pressing the first protrusion, compressing the spring, such that when the spring is compressed via the user pulling on either or both of the first release surface and the second release surface, the latch disengages from the upper receiver of the firearm, allowing retraction of the charging handle from the firearm.

2. The charging handle of claim 1, wherein the secondary handle further comprises a flange integrally connected to the second body and to the top surface, the flange including a slot, wherein part of the flange is positioned within the second recess, and wherein a connector is mounted between the front surface and the rear surface of the head, passing through the slot and the second recess, such that dimensions of the slot limit the upward movement permitted to the secondary handle when the user pulls on the second release surface.

3. The charging handle of claim 1, wherein the primary handle and secondary handle are respectively pivotally mounted to the head with roll pins.

4. The charging handle of claim 1, wherein the primary handle and secondary handle are respectively pivotally mounted to the head with screws.

5. The charging handle of claim 2, wherein the primary handle and secondary handle are respectively pivotally mounted to the head with roll pins, and where the connector is a roll pin.

6. The charging handle of claim 2, wherein the primary handle and secondary handle are respectively pivotally mounted to the head with screws, and where the connector is a roll pin.

7. The charging handle of claim 1, wherein the first release surface and second release surface include a textured surface.

8. The charging handle of claim 2, wherein the first release surface and second release surface include a textured surface.

* * * * *